US007291043B2

(12) United States Patent
Morikawa

(10) Patent No.: US 7,291,043 B2
(45) Date of Patent: Nov. 6, 2007

(54) COAXIAL CABLE, COAXIAL CABLE END-PROCESSING STRUCTURE AND COAXIAL CABLE SHIELDING TERMINAL

(75) Inventor: Taishi Morikawa, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/379,391

(22) Filed: Apr. 20, 2006

(65) Prior Publication Data

US 2006/0264099 A1 Nov. 23, 2006

(30) Foreign Application Priority Data

Apr. 22, 2005 (JP) ..... 2005-124393

(51) Int. Cl.
*H01R 9/05* (2006.01)

(52) U.S. Cl. ..... 439/585; 439/578

(58) Field of Classification Search ..... 439/585, 439/578, 583, 584; 174/75 C, 78, 84 C
See application file for complete search history.

(56) References Cited

U.S. PATENT DOCUMENTS 5,217,392 A * 6/1993 Hosler, Sr. ..... 439/585
5,607,320 A * 3/1997 Wright ..... 439/394
5,796,042 A * 8/1998 Pope ..... 174/102 SP
6,558,194 B2 * 5/2003 Montena ..... 439/585
6,583,357 B2 * 6/2003 Rubenstein et al. ..... 174/360
6,648,683 B2 * 11/2003 Youtsey ..... 439/578
6,753,475 B2 * 6/2004 Takahashi et al. ..... 174/75 C

FOREIGN PATENT DOCUMENTS

JP 2923518 B2 5/1999
JP 2004-55475 A 2/2004

* cited by examiner

*Primary Examiner*—Tulsidas C. Patel
*Assistant Examiner*—Harshad C Patel
(74) *Attorney, Agent, or Firm*—Sughrue Mion Pllc.

(57) ABSTRACT

At the time of connecting a shielding terminal to a coaxial cable, a connecting conductor portion presses a braid of the coaxial cable between an insulator and an insulating sheath of the coaxial cable so as to form a braid-gathering portion of an annular shape, and as a result of formation of the braid-gathering portion, an annular bump portion, serving as a terminal engaging portion, is formed at the insulating sheath. A sheath holding portion is arranged in such a manner that one side edge of the sheath holding portion is positioned adjacent to the terminal engaging portion.

7 Claims, 5 Drawing Sheets

COAXIAL CABLE, COAXIAL CABLE END-PROCESSING STRUCTURE AND COAXIAL CABLE SHIELDING TERMINAL

BACKGROUND OF THE INVENTION

1. Field of the Invention

This invention relates to a coaxial cable, a coaxial cable end-processing structure, and a coaxial cable shielding terminal forming a coaxial connector.

2. Related Art

Generally, a coaxial cable, used for transmitting high-frequency signals as in an antenna wire, comprises, in radially outward sequence, a core conductor serving as a center conductor, an insulator serving as a dielectric, a metallic tape conductor and a braid (which serve as an outer conductor), and an insulating sheath serving as an outer covering. The coaxial cable of this construction has a coaxial connector provided at an end thereof, and the coaxial cable can be connected to a mating equipment, a mating coaxial cable or the like via this coaxial connector. The coaxial connector includes a coaxial cable shielding terminal through which the braid is connected to a mating coaxial connector for grounding purposes so as to intercept electrical noises such as electromagnetic waves and static electricity.

The following connecting structure of connecting a coaxial cable to acoaxial connector has been proposed. Namely, a braid is exposed at an end portion of the coaxial cable, and the exposed braid is undone or unloosed, and then a connecting conductor portion of the coaxial connector is inserted into a gap between the undone braid and a metallic tape conductor (or an insulator) disposed inside this braid. Then, a metallic sleeve, separate from the coaxial cable and the coaxial connector, is press-fastened onto the exposed braid. By thus press-fastening the metallic sleeve, the coaxial cable is electrically and mechanically connected to the coaxial connector (see, for example, JP-A-2004-55475 Publication).

In this connecting structure, the connecting conductor portion of the coaxial connector is inserted into the gap between the braid and the metallic tape conductor (or the insulator) in order to prevent the contours of transverse cross-sections of the insulator and the outer conductor from being deformed out of concentric relation to each other, that is to say, in order to satisfy high-frequency characteristics. This connecting structure is also aimed at satisfying a predetermined tensile strength of the coaxial cable and the coaxial connector.

In the above conventional technique, it is necessary to carry out the operation for undoing the braid, exposed at the end portion of the coaxial cable, in order that the connecting conductor portion of the coaxial cable can be inserted into the inside of the braid of the coaxial cable. Therefore, the conventional connecting structure has a problem that the efficiency of the operation is affected since the cumbersome operation must be carried out.

And besides, in the above conventional technique, the metallic sleeve, separate from the coaxial cable and the coaxial connector, is prepared, and is mounted on the coaxial cable, and therefore it is necessary to produce the metallic sleeve and to effect its mounting operation. Therefore, the conventional connecting structure has problems that the number of the component parts increases and that the efficiency of the operation is affected. Incidentally, when solving the problem with respect to the increased number of the component parts, care must be taken to satisfy the predetermined tensile strength of the coaxial cable and the coaxial connector.

SUMMARY OF THE INVENTION

This invention has been made in view of the above circumstances, and an object of the invention is to provide a coaxial cable, a coaxial cable end-processing structure and a coaxial cable shielding terminal, in which an operation can be easily carried out, and the number of component parts is reduced, and high-frequency characteristics and a tensile strength can be effectively maintained.

(1) The above object has been achieved by a coaxial cable of the invention characterized in that a braid, interposed between an insulator and an insulating sheath, is pressed in an extending direction of the cable to form a braid-gathering portion of an annular shape, composed of the braid, between the insulator and the insulating sheath, and as a result of formation of the braid-gathering portion, an annular bump portion, serving as a terminal engaging portion, is formed at the insulating sheath.

In the invention having the above features, the terminal engaging portion, which is engaged with a coaxial cable shielding terminal so as to satisfy a predetermined tensile strength, is formed at the insulating sheath. The terminal engaging portion is defined by the annular bump portion of the insulating sheath. The terminal engaging portion is formed, using only the construction of the coaxial cable. Namely, the terminal engaging portion is obtained by pressing the braid into the coaxial cable so as to form the braid-gathering portion inside the insulating sheath. When the coaxial cable is connected to the coaxial cable shielding terminal, the provision of the terminal engaging portion can satisfy a predetermined tensile strength, withstanding a terminal withdrawing force, without the need for compressing the insulating sheath hard so as to increase a holding force (fixing force).

(2) The above object has been achieved by a coaxial cable end-processing structure of the invention characterized in that an annular bump portion, serving as a terminal engaging portion, is formed at an insulating sheath of a coaxial cable, and a sheath holding portion of a coaxial cable shielding terminal is press-fastened onto the insulating sheath at a region adjacent to the terminal engaging portion.

In the invention having the above features, when a force is applied in a terminal withdrawing direction, the sheath holding portion of the coaxial cable shielding terminal is engaged with (or caught by) the terminal engaging portion of the coaxial cable. The terminal engaging portion prevents the coaxial cable shielding terminal from being moved. The predetermined tensile strength, withstanding the terminal withdrawing force, can be satisfied without the need for compressing the insulating sheath hard so as to increase the holding force (fixing force).

(3) The coaxial cable end-processing structure of the invention is characterized in that a braid-gathering portion of an annular shape, composed of a braid, is formed between an insulator of the coaxial cable and the insulating sheath, thereby forming the terminal engaging portion at the insulating sheath.

In the invention having the above features, the braid is pressed into the coaxial cable to form the braid-gathering portion inside the insulating sheath, and by doing so, the annular bump portion, serving as the terminal engaging portion, is formed at the insulating sheath. The terminal engaging portion is formed, using only the construction of the coaxial cable.

(4) The above object has been achieved by a coaxial cable shielding terminal of the invention including a tubular connecting conductor portion for being contacted with a braid of a coaxial cable to be electrically connected thereto, a sheath holding portion for being press-fastened on an insulating sheath of the coaxial cable to hold the insulating sheath, characterized in that at the time of connecting the shielding terminal to the coaxial cable, the connecting conductor portion presses the braid between an insulator of the coaxial cable and the insulating sheath so as to form a braid-gathering portion of an annular shape composed of the braid, and as a result of formation of the braid-gathering portion, an annular bump portion, serving as a terminal engaging portion, is formed at the insulating sheath, and the sheath holding portion is arranged in such a manner that one side edge of the sheath holding portion is positioned adjacent to the terminal engaging portion.

In the invention having the above features, at the time of connecting the shielding terminal to the coaxial cable, the braid is pressed in the cable extending direction by the tubular connecting conductor portion, so that the braid-gathering portion, composed of the braid, is formed between the insulator and the insulating sheath. As a result of formation of this braid-gathering portion, the relevant portion of the insulating sheath bumps into an annular shape to form the terminal engaging portion. When the sheath holding portion is press-fastened on the insulating sheath at a region adjacent to the terminal engaging portion, the fixing of the shielding terminal to the coaxial cable is completed. The sheath holding portion need only to be press-fastened on the insulating sheath to such a degree as to be engaged with the terminal engaging portion, and the provision of the terminal engaging portion can satisfy the predetermined tensile strength, withstanding the terminal withdrawing force, without the need for compressing the insulating sheath hard so as to increase the holding force (fixing force).

(5) The coaxial cable shielding terminal of the invention is characterized in that the shielding terminal further includes a second sheath holding portion for holding the insulating sheath at a region where the connecting conductor portion is provided.

In the invention having the above feature, the insulating sheath is held or clamped at the opposite sides of the terminal engaging portion. The second sheath holding portion holds the insulating sheath in such a manner that the insulating sheath is held between the second sheath insulating portion and the connecting conductor portion.

Another aspect of the invention is provided with a method of connecting a coaxial cable with a shielding terminal, comprising the steps of:

pressing a braid into an extending direction of a coaxial cable between an insulator and a insulating sheath in a state that an end surface of a connecting conductor portion in a shielding terminal is abutted with the braid, thereby forming a braid-gathering portion of an annular shape between the insulator and the insulating sheath;

forming a terminal engaging portion provided with an annular bump portion around the braid-gathering portion in the insulating sheath;

positioning a sheath holding portion of the shielding terminal adjacent to the terminal engaging portion; and press-fastening the sheath holding portion onto the insulating sheath.

The invention achieves an advantage that there can be provided the coaxial cable useful for maintaining the high-frequency characteristics and the tensile strength.

The invention achieves an advantage that there can be provided the coaxial cable end-processing structure in which the operation can be carried out easily, and the number of the component parts is reduced, and the high-frequency characteristics and the tensile strength can be effectively maintained.

The invention achieves an advantage that the terminal engaging portion can be easily formed.

The invention achieves an advantage that there can be provided the coaxial cable-shielding terminal in which the operation can be carried out easily, and the number of the component parts is reduced, and the high-frequency characteristics and the tensile strength can be effectively maintained.

The invention achieves an advantage that the tensile strength can be increased.

BRIEF DESCRIPTION OF THE DRAWINGS

FIG. 1A is a cross-sectional view showing a condition before a terminal engaging portion is formed, and FIG. 1B is a cross-sectional view showing a condition after the terminal engaging portion is formed.

DETAILED DESCRIPTION OF THE PREFERRED EMBODIMENTS

Figure 1A:
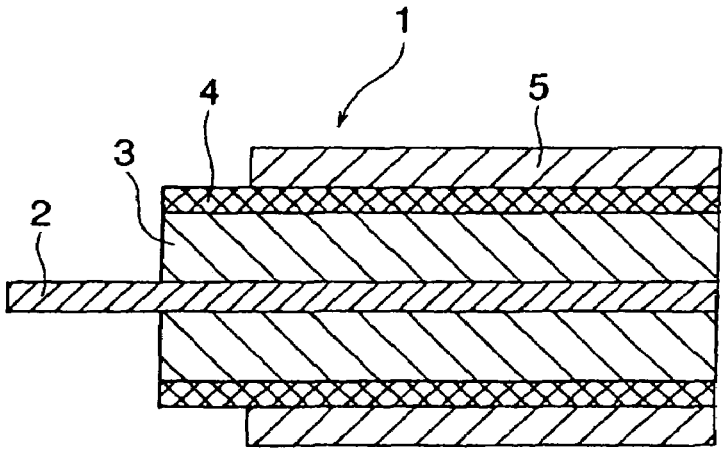
FIGS. 1A and 1B are schematic views showing one preferred embodiment of a coaxial cable of the present invention.
Figure 1B:
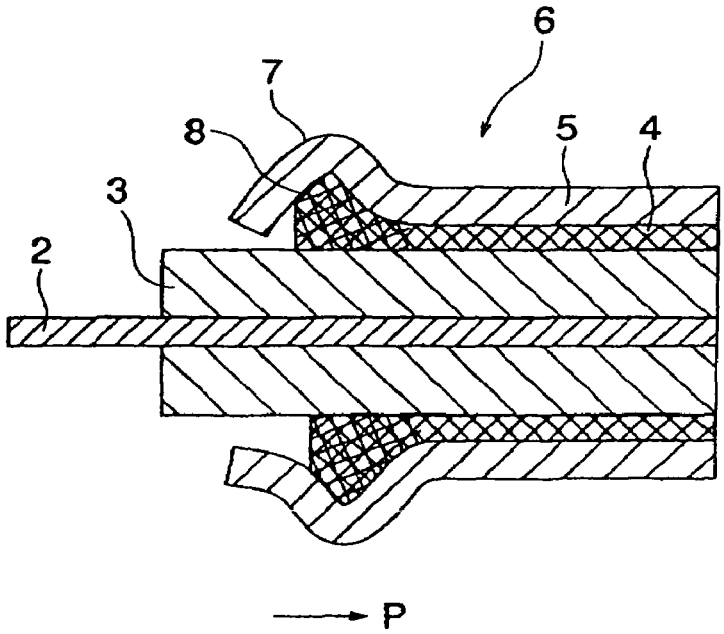

The present invention will now be described with reference to the drawings. FIGS. 1A and 1B are views showing one preferred embodiment of a coaxial cable of the invention, and FIG. 1A is a cross-sectional view showing a condition before a terminal engaging portion is formed, and FIG. 1B is a cross-sectional view showing a condition after the terminal engaging portion is formed.

In FIG. 1A, reference numeral 1 denotes the coaxial cable. The coaxial cable 1 comprises a core conductor 2 serving as a center conductor, an insulator 3 serving as a dielectric, a metallic tape conductor (not shown) and a braid 4 (which serve as an outer conductor), and an insulating sheath 5 serving as an outer covering. The core conductor 2 is disposed at the center of the coaxial cable 1, and the insulator 3, the metallic tape conductor, the braid 4 and the insulating sheath 5 are sequentially provided around the core conductor 2. The core conductor 2, the insulator 3, the metallic taper conductor, the braid 4 and the insulating sheath 5 are well known, and therefore detailed description thereof will be omitted here.

In FIG. 1B, reference numeral 6 denotes the coaxial cable of the invention. The coaxial cable 6 of the invention has the terminal engaging portion 7 formed at the insulating sheath 5. The formation of the terminal engaging portion 7 will be described below with reference to FIGS. 1A and 1B.

First, the sheath, etc., are removed from an end portion of the coaxial cable 1. In this removing operation, the core conductor 2 and the braid 4 are exposed over respective predetermined lengths (The core conductor 2 and the insulator 3 can be exposed while only an end portion of the braid 4 can be exposed). In this condition in which the core conductor 2 and the braid 4 are exposed over the respective predetermined lengths, the exposed braid 4 is pushed or pressed into the coaxial cable in an extending direction of the cable (that is, in a direction of arrow P) to form a braid-gathering portion 8 of an annular shape (composed of the braid 4) between the insulator 3 and the insulating sheath 5. As a result of formation of the braid-gathering portion 8 between the insulator 3 and the insulating sheath 5, an annular bump portion, serving as the terminal engaging portion 7, is formed at the insulating sheath 5 (The formation of this terminal engaging portion will hereafter be more fully described.)

Next, one preferred embodiment of a coaxial cable end-processing structure of the invention, as well as one preferred embodiment of a coaxial cable shielding terminal of the invention, will be described with reference to FIGS. 2 to 6. In this description, the coaxial cable of the invention will also be more specifically described.

Figure 2:
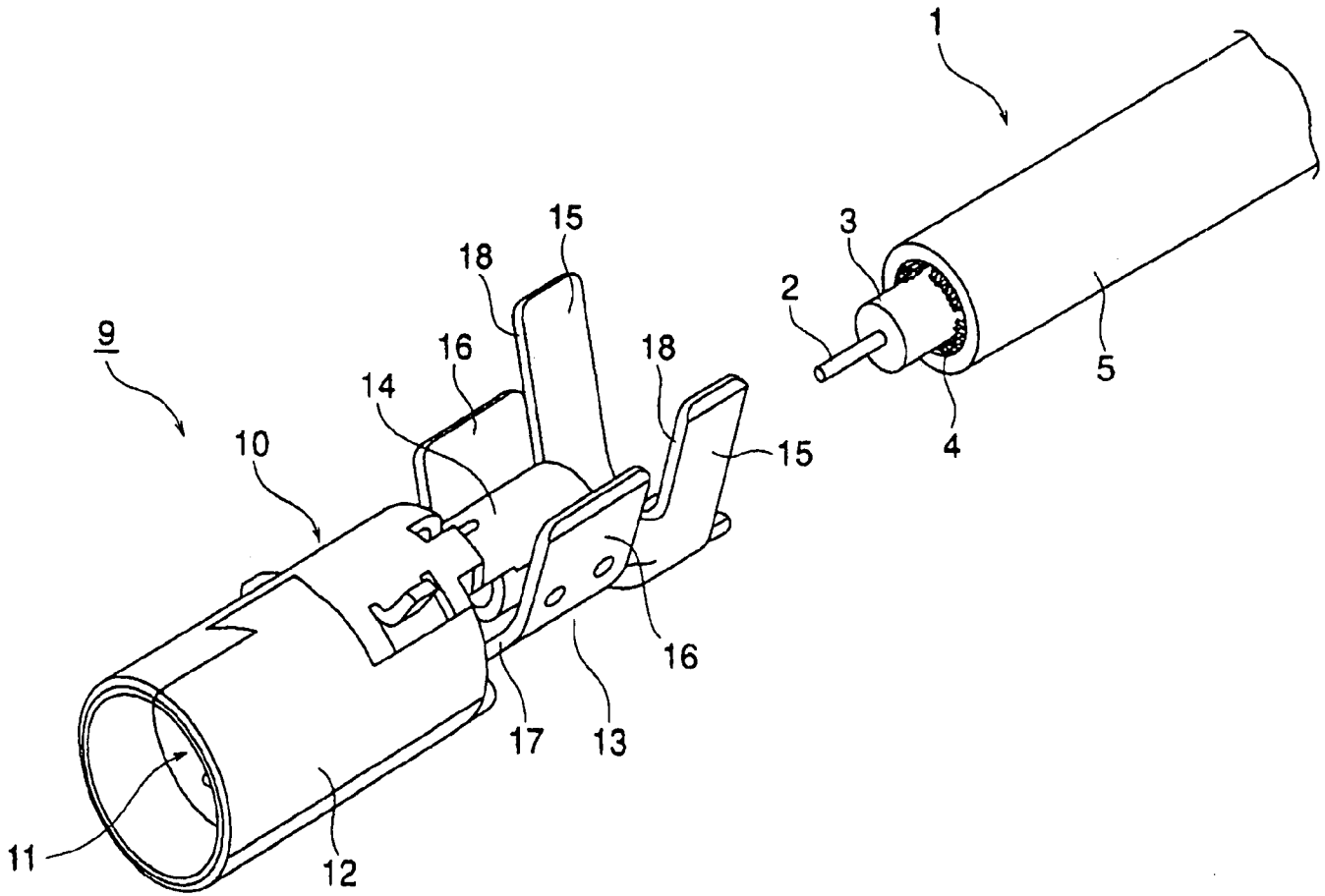
FIG. 2 is a perspective view showing one preferred embodiment of a coaxial cable end-processing structure of the invention and one preferred embodiment of a coaxial cable shielding terminal of the invention.
Figure 3:
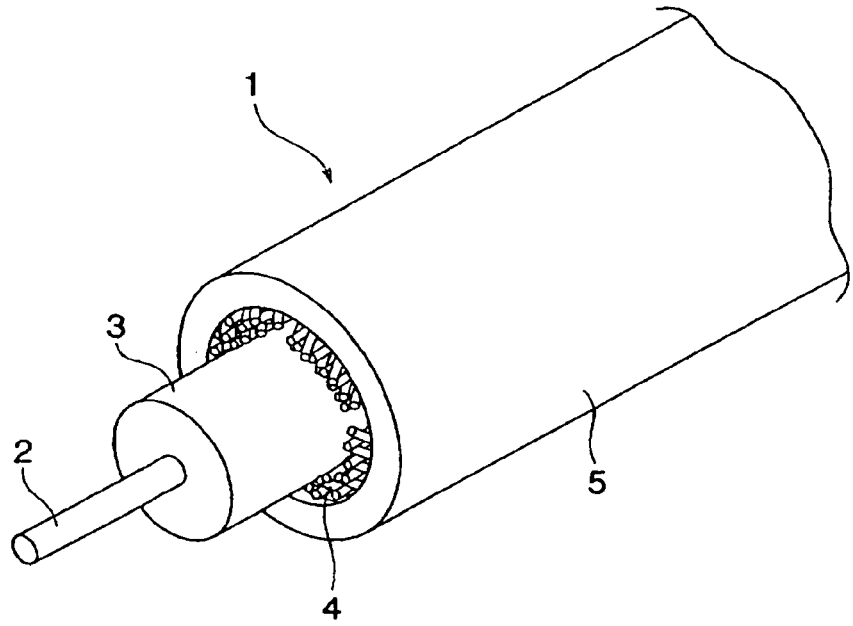
FIG. 3 is an enlarged perspective view showing an end portion of the coaxial cable.
Figure 4:
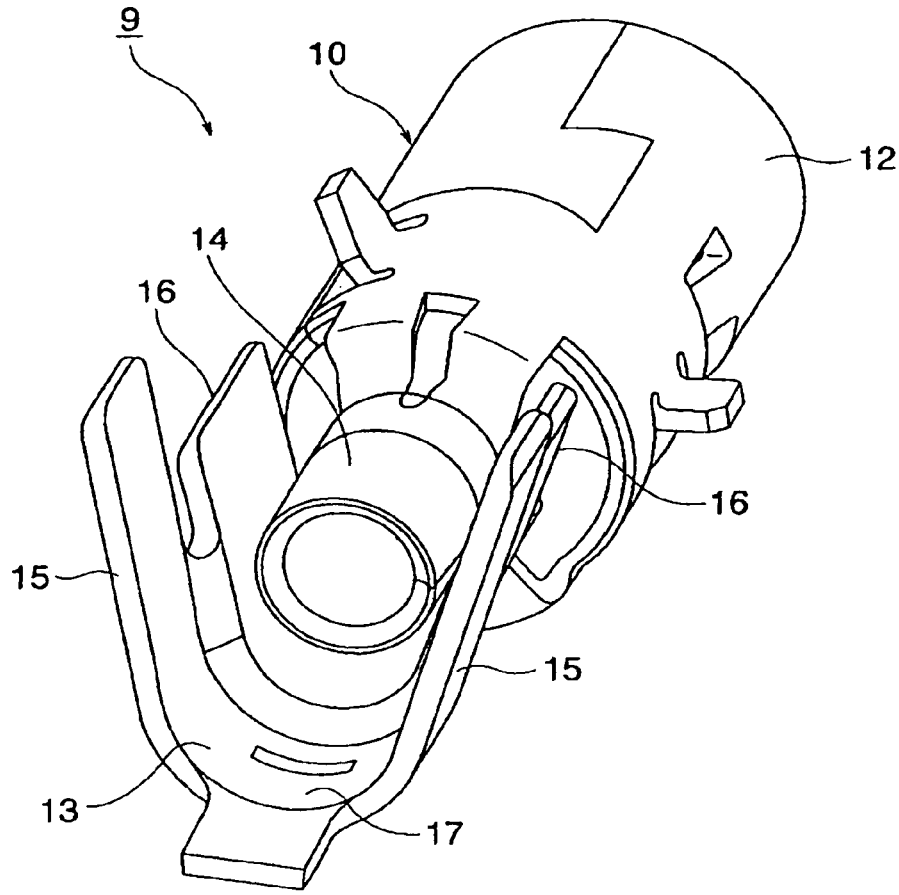
FIG. 4 is an enlarged perspective view showing an important portion of the coaxial cable shielding terminal.
Figure 5:
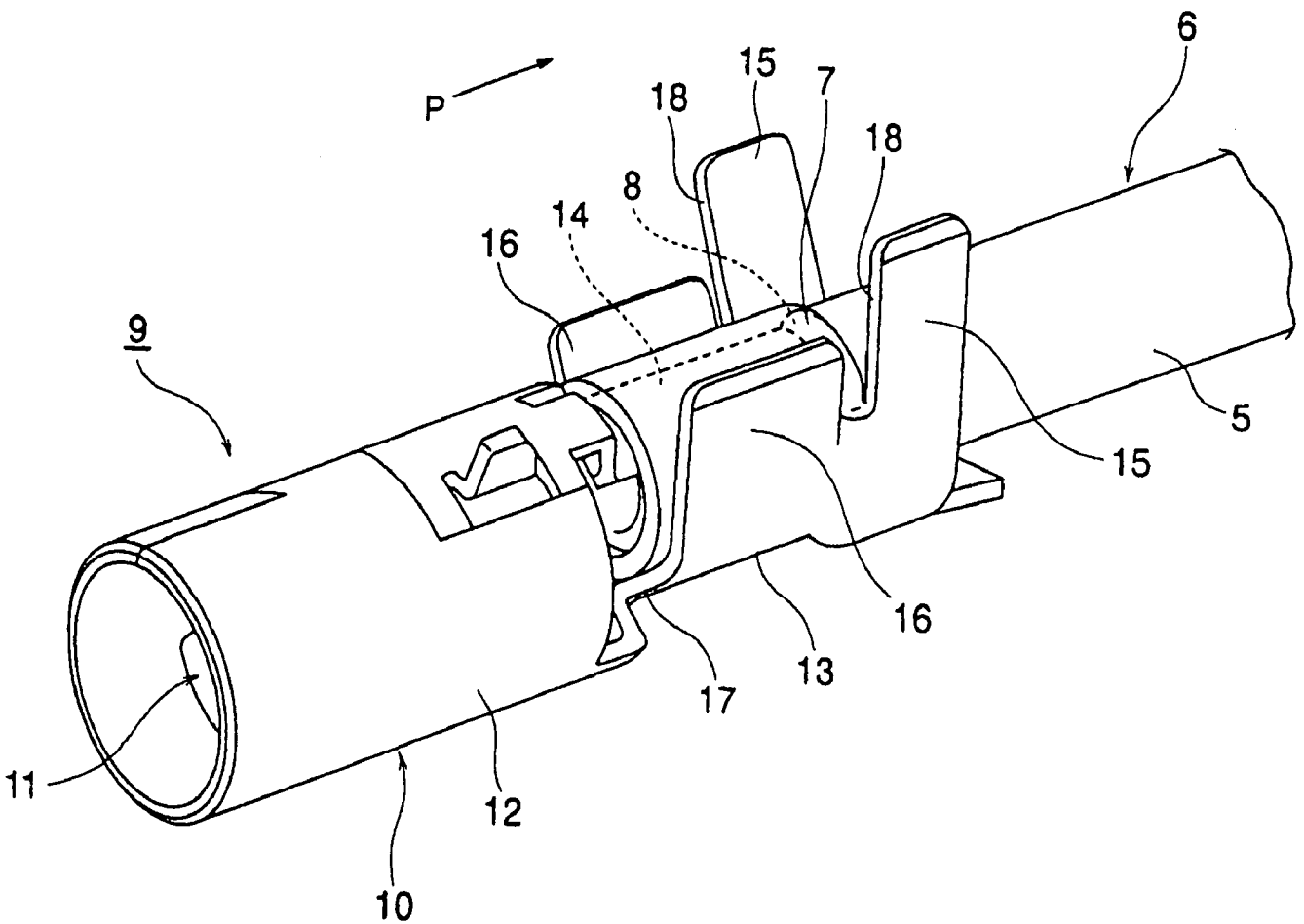
FIG. 5 is a perspective view showing a condition in which the coaxial cable is connected to the coaxial cable shielding terminal.
Figure 6:
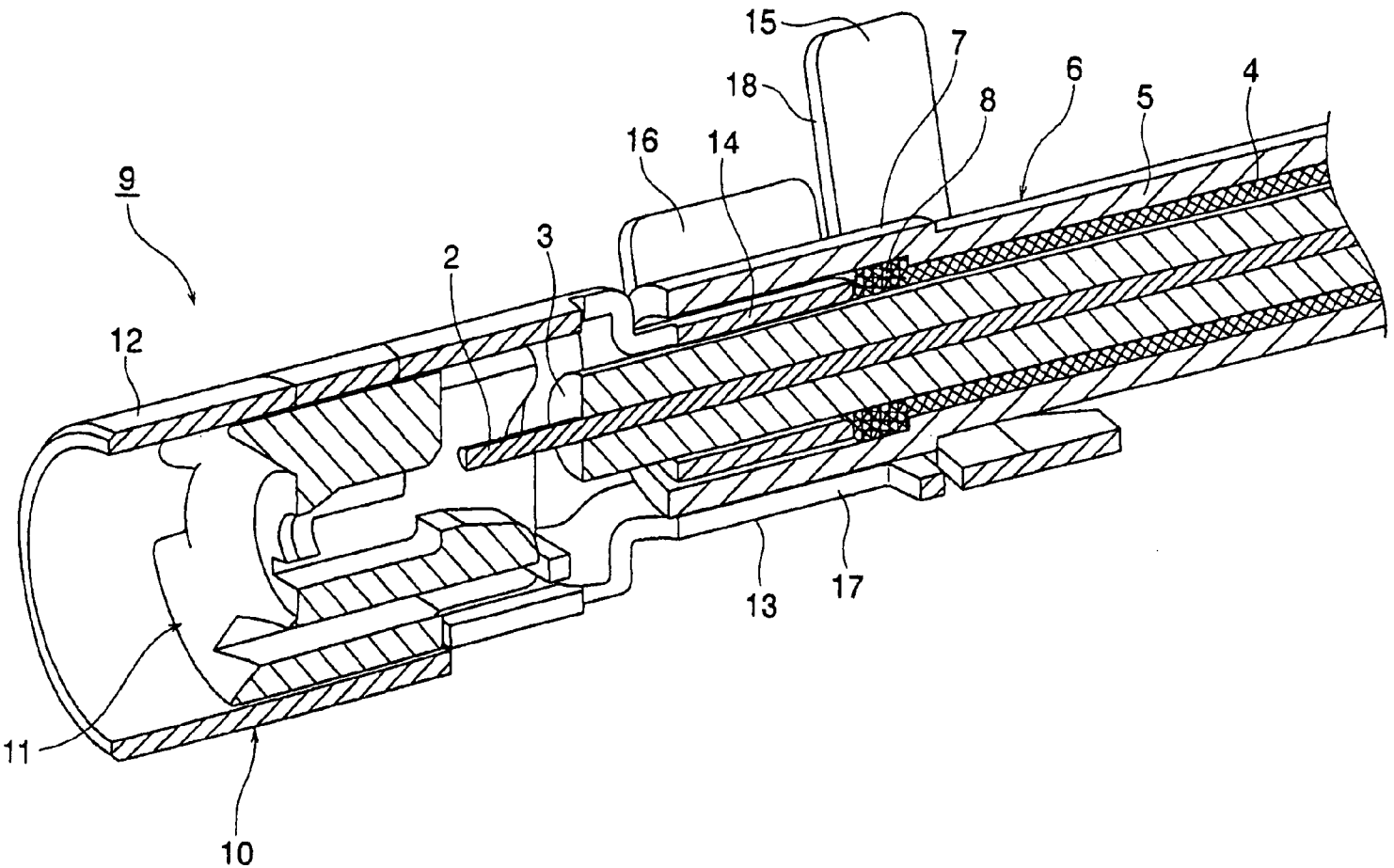
FIG. 6 is a cross-sectional view showing the condition in which the coaxial cable is connected to the coaxial cable shielding terminal.

FIG. 2 is a perspective view showing the coaxial cable end-processing structure of the invention and the coaxial cable shielding terminal of the invention, FIG. 3 is an enlarged perspective view showing an end portion of the coaxial cable, FIG. 4 is an enlarged perspective view showing an important portion of the coaxial cable shielding terminal, FIG. 5 is a perspective view showing a condition in which the coaxial cable is connected to the coaxial cable shielding terminal, and FIG. 6 is a cross-sectional view showing the condition in which the coaxial cable is connected to the coaxial cable shielding terminal.

In FIG. 2, reference numeral 9 denotes a coaxial connector which is to be connected to the end portion of the coaxial cable 1 (6). The coaxial connector 9 includes an inner terminal (not shown), the shielding terminal (coaxial cable shielding terminal) 10, and an dielectric 11.

The inner terminal (not shown) is electrically and mechanically connected to the core conductor 2 of the coaxial cable 1. The inner terminal (not shown) has electrical conductivity, and in this embodiment, this inner terminal is formed into a pin-like shape. In FIGS. 2 and 4, the shielding terminal 10 is formed by processing a thin metal sheet into a predetermined shape. The shielding terminal 10 includes a shielding portion 12 receiving the dielectric 11, and a press-clamping portion 13 for the coaxial cable 1 (6).

The shielding portion 12 serves as a portion for connection to a mating connector (not shown), and is formed into a cylindrical tubular shape. The dielectric 11 is received within the shielding portion 12 so as to slide forward and rearward. A pin-like distal end portion of the inner terminal (not shown) is inserted into the dielectric 11 at a center thereof, and is fixed thereto.

The press-clamping portion 13 includes a connecting conductor portion 14, a sheath holding portion 15, and a second sheath holding portion 16. The connecting conductor portion 14 is formed into a cylindrical tubular shape so as to be inserted between the insulator 3 and the insulating sheath 5 of the coaxial cable 1. The connecting conductor portion 14 extends from a rear end of the shielding portion 12.

The sheath holding portion 15 and the second sheath holding portion 16 extend from a base portion 17. The base portion 17 is a strip-like portion spaced a predetermined distance from the connecting conductor portion 14, and this base portion 17 is integrally connected at its one end to the rear end of the shielding portion 12. The sheath holding portion 15 comprises a pair of press-fastening piece portions, and similarly the second sheath holding portion 16 comprises a pair of press-fastening piece portions. The second sheath holding portion 16 is formed outside the connecting conductor portion 14, and is disposed in registry therewith. The sheath holding portion 15 is spaced a predetermined distance (which is determined according to a width of the terminal engaging portion 7) from the second sheath holding portion 16. The sheath holding portion 15 is disposed rearwardly of the second sheath holding portion 16.

In FIGS. 2 and 3, the insulator 3, the braid 4 and the insulating sheath 5 are removed over respective predetermined lengths from the coaxial cable 1. The core conductor 2 is exposed over such a length as to be suitably connected to the inner terminal (not shown). Only an end portion of the braid 4 is exposed from an end surface of the insulating sheath 5. When the coaxial connector 9 is mounted on the end portion of this coaxial cable 1, the coaxial cable 6 of the invention is formed during this mounting process.

In the above construction, the shielding terminal 10, receiving the dielectric 11, is located adjacent to the end portion of the coaxial cable 1 as shown in FIG. 1, and in this condition the electrical connection and mechanical fixing of these parts are started. First, the core conductor 2 and the insulator 3 are inserted into the connecting conductor portion 14 until the braid 4, exposed from the end surface of the insulating sheath 5, is brought into abutting engagement with the end surface of the connecting conductor portion 14. Then, in this condition in which the end surface of the connecting conductor portion 14 is held against the braid 4, the connecting conductor portion 14 is pushed or forced into the coaxial cable in the cable-extending direction (direction of arrow P) as shown in FIGS. 5 and 6.

At this time, the annular braid-gathering portion 8, composed of the braid 4, is formed between the insulator 3 and the insulating sheath 5. When the connecting conductor portion 14 is forced into the coaxial cable 1 as described above, the end portion of the braid 4 is formed into a bulky shape to provide the annular braid-gathering portion 8, having a thickness of the braid-gathering portion is greater than the thickness of the other portion of braid. As a result of formation of this braid-gathering portion 8, the annular bump portion, serving as the terminal engaging portion 7, is formed at the insulating sheath 5. When the terminal engaging portion 7 is thus formed, the coaxial cable 6 of the invention is formed.

In this condition in which the coaxial cable 6 of the invention is thus formed, the connecting conductor portion 14 is kept inserted between the insulator 3 and insulating sheath 5 at a region adjacent to the front end of the terminal engaging portion 7. The connecting conductor portion 14 and the braid-gathering portion 8 contact each other, and therefore electrical connection therebetween is made in a provisional condition.

Finally, when the sheath holding portion 15 and the second sheath holding portion 15 are press-fastened onto the insulating sheath 5 to hold the same, the series of operations are completed. The sheath holding portion 15, as well as the second sheath holding portion 16, is press-fastened on the insulating sheath 5 to extend around this insulating sheath 5. At this time, the sheath holding portion 15 is press-fastened onto the insulating sheath 5 in such a manner that one side edge 18 of each of the pair of press-fastening piece portions thereof is positioned adjacent to the terminal engaging portion 7. The second sheath holding portion 16 is press-fastened onto the insulating sheath 5 in such a manner that the portion of the insulating sheath 5, positioned adjacent to the front end of the terminal engaging portion 7, is held between the second sheath holding portion 16 and the connecting conductor portion 14. When the press-fastening of the sheath holding portion 15 and the press-fastening of the second sheath holding portion 16 thus are completed, the mechanical fixing operation is completed, and also the connecting conductor portion 14 is completely electrically connected to the braid-gathering portion 8.

Even if a force is applied in a direction to withdraw the coaxial connector 9, the side edges 18 of the pair of press-fastening piece portions of the sheath holding portion 15 are engaged with (or caught by) the terminal engaging portion 7 of the coaxial cable 6. The terminal engaging portion 7 prevents the coaxial connector 9 from being moved in the withdrawing direction.

As described above with reference to FIGS. 1 to 6, in the invention, the coaxial cable 6, having the terminal engaging portion 7, is used, and also the shielding terminal 10, corresponding to this coaxial cable 6, is used. Therefore, the predetermined tensile strength, withstanding the terminal withdrawing force, can be satisfied without the need for compressing the insulating sheath 5 hard by the sheath holding portion 15 so as to increase the holding force (fixing force).

In the invention, the operation can be carried out more easily as compared with the conventional structure, and besides the number of the component parts is reduced, and furthermore the high-frequency characteristics and the tensile strength can be effectively maintained.

In the invention, various modifications can be made without departing from the subject matter of the invention.

What is claimed is:

1. A coaxial cable comprising:

a braid-gathering portion of an annular shape formed by pressing a braid in an extending direction of said cable between an insulator and an insulating sheath, said braid-gathering portion being defined by a gathering of the braid in longitudinal and radial directions of the cable such that the braid-gathering portion protrudes radially from the cable and such that a thickness of the braid-gathering portion is greater than a thickness of other portions of the braid; and an annular bump portion formed around said braid-gathering portion in said insulating sheath.

2. A coaxial cable end-processing structure comprising:

a terminal engaging portion provided with an annular bump portion formed at an insulating sheath of a coaxial cable; and a sheath holding portion of a coaxial cable shielding terminal press-fastened onto said insulating sheath at a region adjacent to said terminal engaging portion, wherein a braid-gathering portion of an annular shape, composed of a braid, is formed between an insulator of said coaxial cable and said insulating sheath, thereby forming said terminal engaging portion at said insulating sheath and wherein said braid-gathering portion is defined by a gathering of the braid in longitudinal and radial directions of the cable such that the braid-gathering portion protrudes radially from the cable and such that a thickness of said braid-gathering portion is greater than a thickness of other portions of the braid.

3. A coaxial cable end-processing structure according to claim 2, wherein a braid-gathering portion of an annular shape, composed of a braid, is formed between an insulator of said coaxial cable and said insulating sheath, thereby forming said terminal engaging portion at said insulating sheath.

4. A coaxial cable shielding terminal comprising:

a tubular connecting conductor portion for being contacted with a braid of a coaxial cable to be electrically connected thereto; and a sheath holding portion for being press-fastened on an insulating sheath of said coaxial cable to hold an insulating sheath of said coaxial cable;

wherein a braid-gathering portion of an annular shape is formed by pressing a braid in an extending direction of said cable between an insulator and said insulating sheath, said braid-gathering portion being defined by a random gathering of the braid in longitudinal and radial directions of the cable such that the braid-gathering portion protrudes radially from the cable and such that a thickness of the braid-gathering portion is greater than a thickness of other portions of the braid;

a terminal engaging portion provided with an annular bump portion is formed around said braid-gathering portion in said insulating sheath; and said sheath holding portion is arranged in such a manner that one side edge of said sheath holding portion is positioned adjacent to said terminal engaging portion.

5. A coaxial cable shielding terminal according to claim 4, wherein said shielding terminal further includes a second sheath holding portion for holding said insulating sheath at a region where said connecting conductor portion is provided.

6. A method of connecting a coaxial cable with a shielding terminal, comprising the steps of:

pressing a braid into an extending direction of a coaxial cable between an insulator and a insulating sheath in a state tat an end surface of a connecting conductor portion in a shielding terminal is abutted with said braid to cause said braid to be pushed longitudinally, thereby forming a braid-gathering portion of an annular shape between said insulator and said insulating sheath, said braid-gathering portion being defined by a gathering of the braid in longitudinal and radial directions of the cable such that the braid-gathering portion protrudes radially from the cable and such tat a thickness the braid-gathering portion is greater than a thickness of other portions of the braid;

forming a terminal engaging portion provided with an annular bump portion around said braid-gathering portion in said insulating sheath;

positioning a sheath holding portion of said shielding terminal adjacent to said terminal engaging portion; and press-fastening said sheath holding portion onto said insulating sheath.

7. A method of connecting a coaxial cable with a shielding terminal, according to claim 6, wherein a second sheath holding portion of said shielding terminal is press-fastened to hold said insulating sheath at a region where said connecting conductor portion is provided.

* * * * *